US005283913A

United States Patent [19]

Jaeckels

[11] Patent Number: 5,283,913

[45] Date of Patent: Feb. 8, 1994

[54] WATER CONSERVING TOILET

[75] Inventor: Norman J. Jaeckels, Sheboygan, Wis.

[73] Assignee: Kohler Co., Kohler, Wis.

[21] Appl. No.: 49,216

[22] Filed: Apr. 19, 1993

[51] Int. Cl.[5] ..... E03D 11/08

[52] U.S. Cl. ..... 4/420; 4/421; 4/216

[58] Field of Search ..... 4/420, 420.5, 421, 422, 4/425, 428, 216, 311, 329, 344, 348, 349, 423, 424, 426, 427

[56] References Cited

U.S. PATENT DOCUMENTS

| | | | |
|---|---|---|---|
| 271,752 | 2/1883 | Wellington | 4/425 |
| 396,623 | 1/1889 | Sniffen . | |
| 441,268 | 11/1890 | Weeden | 4/424 |
| 879,421 | 2/1908 | Stevenson et al. . | |
| 1,152,962 | 9/1915 | Muckenhirn . | |
| 1,159,445 | 11/1915 | Watrous . | |
| 1,198,454 | 9/1916 | Kelly . | |
| 1,211,137 | 1/1917 | Grant . | |
| 1,533,860 | 4/1925 | Hoge . | |
| 1,675,841 | 7/1928 | Cohoon . | |
| 1,742,790 | 1/1930 | Smith | 4/425 |
| 1,822,378 | 9/1931 | Schossow . | |
| 1,966,786 | 7/1934 | Brain | 4/69 |
| 1,977,797 | 10/1934 | Kohler et al. | 4/9 |
| 2,156,108 | 4/1939 | Brain | 4/73 |
| 2,166,573 | 7/1939 | Teahen | 4/69 |
| 3,131,402 | 5/1964 | Roberts | 4/14 |
| 4,159,550 | 7/1979 | Tobin Jr. | 4/319 |
| 4,232,410 | 11/1980 | Forsbuml/a/ ck et al. | 4/415 |
| 4,277,854 | 7/1981 | Tsai | 4/420 |
| 4,439,874 | 4/1984 | Schrock | 4/300 |
| 4,835,797 | 6/1989 | Castelli | 4/329 |
| 4,987,616 | 1/1991 | Ament | 4/421 |
| 5,218,726 | 1/1993 | Jaeckels et al. | 4/425 |

FOREIGN PATENT DOCUMENTS

| | | | |
|---|---|---|---|
| 440914 | 1/1936 | United Kingdom | 4/420 |

*Primary Examiner*—Ernest G. Cusick
*Assistant Examiner*—Charles R. Eloshway
*Attorney, Agent, or Firm*—Quarles & Brady

[57] ABSTRACT

A toilet which uses a reduced amount of water is disclosed. In one aspect there is a toilet having a bowl with an upper lip and a lower wall having a sump portion at its base. The sump is connected through a bowl outlet to a siphon for the discharge of cleaning liquid and waste from the bowl. A hollow rim receives cleaning liquid, the rim having a rim floor adjacent the upper lip of the bowl and being constructed to allow cleaning liquid to enter the bowl through a first and a second hole in the rim floor. A well is formed in the rim floor. The second hole is in the well floor. A partial block is also provided in the well and the well floor is sloped.

7 Claims, 3 Drawing Sheets

WATER CONSERVING TOILET

FIELD OF THE INVENTION

This invention relates generally to toilets and more specifically to toilets using a reduced amount of water.

DESCRIPTION OF THE ART

Increased interest in water conservation has led to the development of water conserving toilets which use less water, during each flush, than standard toilets. A standard toilet may use three gallons per flush, compared to a water conserving toilet which may reduce this amount by more than half.

Reducing the amount of water required to flush a toilet without adding complex devices to the toilet tank is difficult because a fixed amount of water is normally required to ensure siphon action, clean the toilet and refill the toilet bowl. In gravity feed toilets, such as are used in most residential homes and many buildings, a storage tank is prefilled from the water supply to a predetermined level and is controlled by a float actuated valve. When the toilet is flushed, a flush valve in the tank opens, releasing water to the rim of the toilet.

The water in such toilets passes both clockwise and counter-clockwise from the back of the rim to the front of the rim and proceeds through holes therein to the toilet bowl. A siphon connects the lowermost "sump" portion of the toilet bowl to a drain pipe allowing the flushing water and waste to exit the toilet bowl. See e.g. U.S. Pat. No. 1,966,786.

Co-pending U.S. Pat. application Ser. No. 07/742,975, filed Aug. 9, 1991, issue fee paid Jan. 12, 1993, describes a water conserving toilet that generates a siphon action by directing water toward the toilet sump through multiple jet holes positioned in the front of the rim. A bifurcated stream of water traveling through the rim in both the clockwise and counter-clockwise directions combines at the front of the rim to produce a water jet through these holes. In order for the water jet to emerge from the holes at an angle straight toward the sump portion of the bowl, the clockwise and counter-clockwise water pressures within the rim must be identical. Even a minor difference in water pressure can result in the water jet being off center.

It is somewhat difficult to manufacture sufficiently symmetrical toilets in which water travelling through the rim in a clockwise direction is identical to water travelling in the counter-clockwise direction. When manufacturing variables inherent to the process can cause the toilets to produce an "off center" water jet and, consequently, variable waste removal performance.

Thus, a need exists for an improved low cost water conserving toilet that is capable of generating consistent and strong siphon action with every flush notwithstanding being manufactured to a less stringent tolerance requirement.

SUMMARY OF THE INVENTION

The present invention provides a water conserving toilet that generates a reliable siphon action.

Specifically, the toilet has a bowl with an upper lip and a lower wall having a sump at its base. The sump is connected through a bowl outlet to a siphon for the discharge of a cleaning liquid and waste from the bowl. A hollow rim, receiving the cleaning liquid, has a rim floor adjacent to the upper lip of the bowl, the rim being constructed and arranged to allow passage of cleaning liquid into the bowl through a first hole and a second hole. The rim has a well with a well floor formed in the rim floor adjacent the front of the bowl. The first hole is formed in the rim floor, the second hole is formed in the well floor and the second hole opens inside the rim at a lower level than the first hole opens inside the rim.

In one aspect, the second hole may have a larger radii than the first hole so as to pass a more powerful stream of water into the bowl. In another aspect, a plurality of first holes may be provided in the rim floor, a plurality of second holes may be provided in the well floor and a blocking member may be positioned within the well adjacent the front of the rim and equally dividing the second plurality of holes.

In yet another aspect, the well floor may slope from a high point which is toward the center of the bowl to a low point at the front of the bowl so that a central longitudinal axis of a second hole may be parallel to an adjacent portion of the lower wall the of bowl.

As will be understood from the description below, the well, operating in conjunction with the blocking member and the large radii holes, generates a strong and precisely directed water jet that properly begins an adequate siphon action with minimal water despite minor unit to unit variations in toilets of the same design.

The objects of the invention therefore include providing a toilet of the above kind:

a) where ample water is provided to siphon initiating jet holes to begin a siphon action for removing waste and standing water from the toilet sump;

b) where the water jet of every toilet is more precisely centered on the sump portion of the toilet bowl;

c) where waste removal performance is thorough and consistent between flushes;

d) which is relatively inexpensive to produce and which has simple and durable components; and e) which does not require the addition of mechanical devices to the tank.

These and other objects and advantages of the invention will be apparent from the description that follows. In the description reference is made to the accompanying drawings which form a part hereof and in which there is shown by way of illustration embodiments of the invention. Such embodiments do not necessarily represent the full scope of the invention. Reference should therefore be made to the claims herein for interpreting the scope of the invention.

DESCRIPTION OF THE PREFERRED EMBODIMENT

Figure 1:
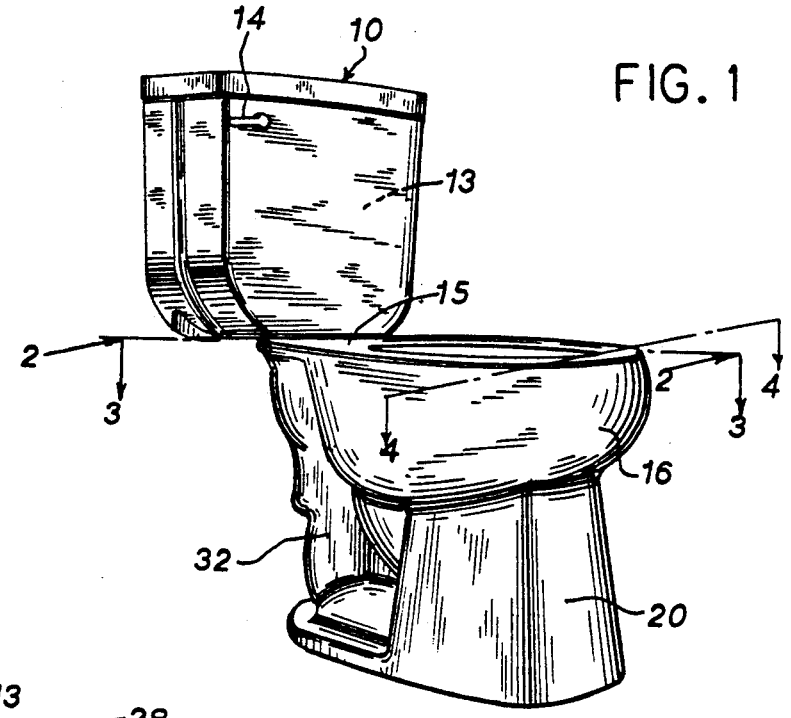
FIG. 1 is a perspective view of a water conserving toilet of the present invention.

Referring to FIG. 1, a toilet 10 that conserves cleaning liquid (normally water) has a tank 12 connected to a water supply (not shown) to store water 13 between the flushing cycles of the toilet 10. The tank 12 is filled by processes well known in the art (e.g. a float activated inlet valve). The tank 12 is positioned on a shelf 15 at the rear, and above, an upwardly facing bowl 16. As is well known, the tank could instead be integrally formed with the bowl. The bowl 16 is surrounded at its upper lip by a hollow rim 18. A flush lever 14 on the tank 12 allows the toilet 10 to be flushed in the conventional manner.

Figure 2:
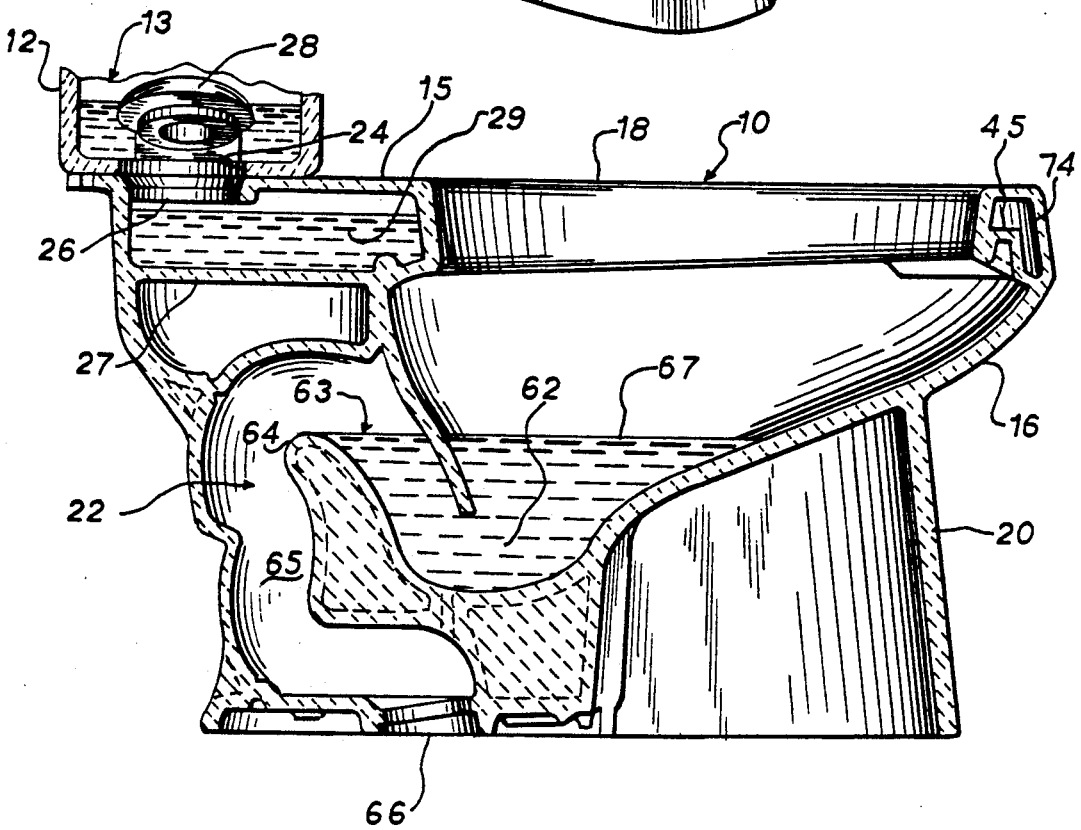
FIG. 2 is a sectional view taken along line 2—2 of FIG. 1.

Shown in FIG. 2, a skirt 20 generally supports the underside of the bowl 16 and hides a siphon trapway 22 at its rear. The siphon trapway 22 provides a passage from the bowl 16 to a vertical drain pipe (not shown) in the floor. If desired, the drain could also be formed towards a wall behind the toilet.

The tank 12 has an opening 24 in its bottom wall matched to a similar opening 26 in the upper surface of the shelf 15 of the rim 18. A conventional flapper valve 28 blocks the passage formed by openings 24 and 26 in the usual manner, and is held in place over the opening 24 by the pressure of the water 13 within tank 12. As is well known, flapper valve 28 may be lifted by means of a chain (not shown) attached between the flapper valve 28 and the flush lever 14.

The lowermost portion of the bowl 16 forms the sump 62. The sump 62 is a steep depression in the inner surface of bowl 16 intended to concentrate solid waste within its volume. The sump 62 communicates with the siphon trapway 22 having an upleg 63 passing over a trap weir 64 and connecting to a downleg 65 communicating with the floor drain 66. Prior to flushing the toilet 10, the sump 62 is filled with water to level 67 generally defined by the height of the trap weir 64. Additional water added to the bowl 16 raises the water level above level 67 and causes it to passes over the trap weir 64 to the floor drain 66. The water in the sump 62 seals the siphon trapway 22.

Beneath opening 26 in shelf 15 is a receiving chamber or entry passage 29. Water 13 passes from tank 12 through openings 24 and 26, and strikes floor 27 of the receiving chamber 29.

The receiving chamber 29 communicates at its front edge with the rim 18 so as to direct water along both sides of the bowl (in both a clockwise and counter-clockwise direction about the interior of rim 18) toward the front of the toilet 10.

Figure 5:
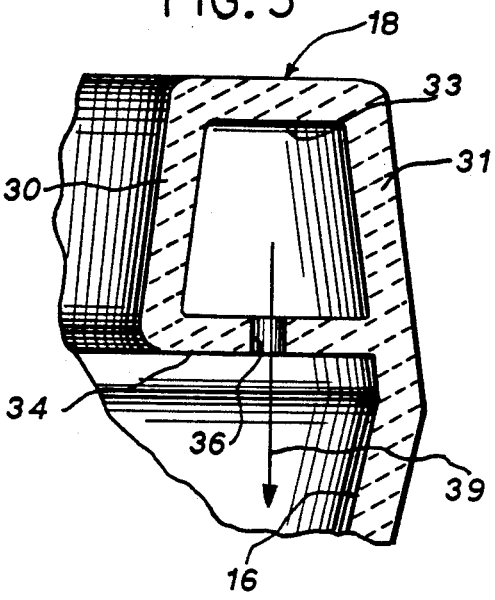
FIG. 5 is a cross-sectional view taken along curved line 5—5 of FIG. 4.
Figure 7:
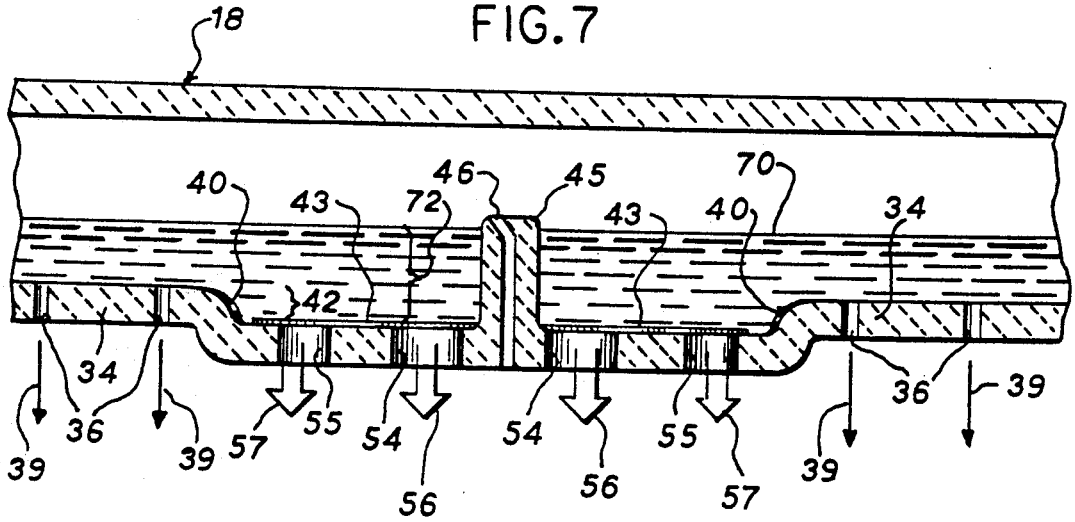
FIG. 7 is a cross sectional view taken along line 7—7 of FIG. 4 albeit with a vent hole added to reflect a second embodiment in which the blocking member is a thinner pipe.

Referring to FIG. 5, the back and side portions of the rim 18 have a generally rectangular cross section having substantially parallel and vertical side walls 30, 31 and substantially parallel and horizontal ceiling 33 and floor 34. Referring also to FIG. 7, the back and side portions of the rim floor 34 are perforated by a plurality of cleaning holes 36 that allow fluid communication between the internal volume of the rim 18 and the interior of the bowl 16.

The rim 18 is mounted so that the floor 34 projects inward over the bowl 16 to allow water passing from the rim 18 through the cleaning holes 36 to flow down the inner surface of the bowl 16. Referring to FIG. 5, water exiting the rim 18 through the cleaning holes 36 form cleaning streams 39 that impact adjacent portion of the bowl 16 at an angle. Thus, water exiting the rim 18 at the sides and back of the bowl 16 impart a scrubbing force to the adjacent portions of the bowl 16 to clean the interior of the bowl 16.

Referring to FIGS. 3–7, downward transverse ramps 40 are positioned on each side of the rim floor 34, adjacent the front of the rim 18. The area between the two ramps 40 defines a well 42 with a well floor 43 lower than the main rim floor 34. Centrally located in the well 42 and directly opposing the receiving chamber 29 within the rim 18 is an upwardly extending hemispherical blocking member 45. The blocking member 45 is positioned at a point where the bifurcated streams of water from the receiving chamber 29 meet after passing in counter-clockwise and clockwise directions through the rim 18.

Referring to FIG. 7, in a second embodiment, the blocking member 45 consists of a thin upward protrusion. An air hole 46 may be provided at the upper end of the blocking member 45 to allow air to escape from the rim 18 upon a flush. It is desirable to have the air hole 46 positioned above the normal peak water level 70 to ensure that air may escape at all times during the flush. However, in some embodiment, the air hole 46 is not positioned above the peak water level 70.

Figure 6:
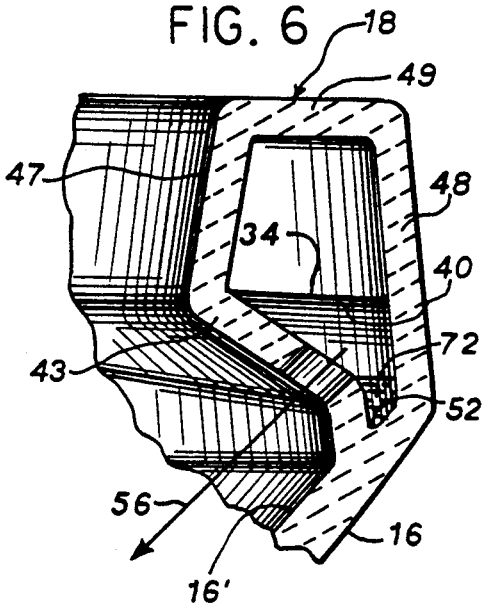
FIG. 6 is a cross sectional view taken along line 6—6 of FIG. 4.

Referring to FIG. 6, the well 42 portion of the rim 18 adjacent the front of the bowl 16 has a generally trapezoidal cross section wherein the side walls 47, 48 are substantially parallel, the ceiling 49 is substantially horizontal and the well floor 43 slopes downward from the internal side wall 47 to the external side wall 48.

Figure 3:
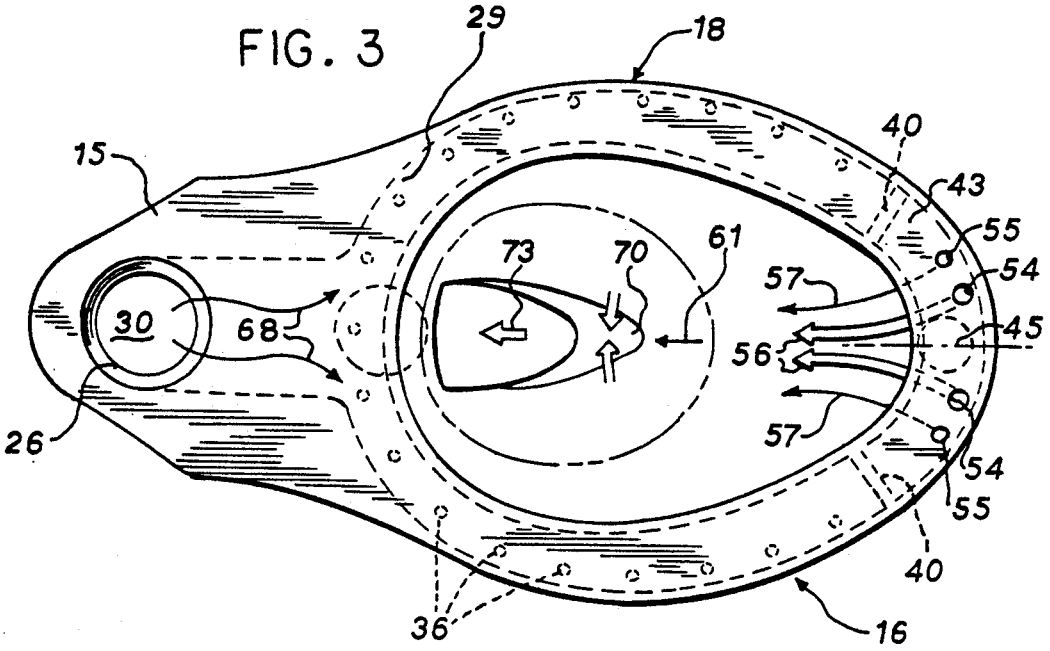
FIG. 3 is a top plan view of the rim and bowl of FIG. 1.

Referring to FIG. 3, the well floor 43 is perforated by two main jet holes 54 and two shepherding holes 55 that also allow fluid communication between the internal volume of the rim 18 and the bowl 16.

Holes 54, 55 have a significantly larger radii than the cleaning holes 36. However, because these holes 54, 55 are positioned on the well floor 43 lower within the rim 18 than the cleaning holes 36, upon flushing action the water exiting these holes 54, 55 is under a greater pressure than that exiting the higher cleaning holes 36.

Importantly, the higher water pressure within the well 42, above the jet holes 54 and shepherding holes 55, means less water volume is needed to produce adequate jet and shepherding streams 56, 57. Therefore, the jet holes 54 and shepherding holes 55 can have smaller radii than would be necessary if they were higher within the rim 18.

Referring again to FIG. 6, the jet holes 54 and shepherding holes 55 are positioned higher on the well floor 52 than the lowest point 52 within the well 42. Therefore, pools 72 are formed within the well 42 below the holes 54, 55. The front of the rim 18, like the back and sides, is mounted so that the well floor 43 projects inward over the bowl 16 to allow water passing from the rim 18 through the jet 54 and shepherding 55 holes to flow into the bowl 16.

The well floor 43 is substantially perpendicular to an adjacent portion 16, of the bowl 16. Water exiting the rim 18 through jet (shown in FIG. 7) and shepherding holes 54, 55 (the axis of these holes being perpendicular to the well floor 43) flow along jet (see FIG. 3) and shepherding streams 56, 57 in a path parallel to adjacent portions of the bowl 161.

Thus, because the water exiting the rim 18 at the front of the bowl 16 impacts the bowl 16 obliquely, the water maintains its velocity down into the bowl 16.

Figure 4:
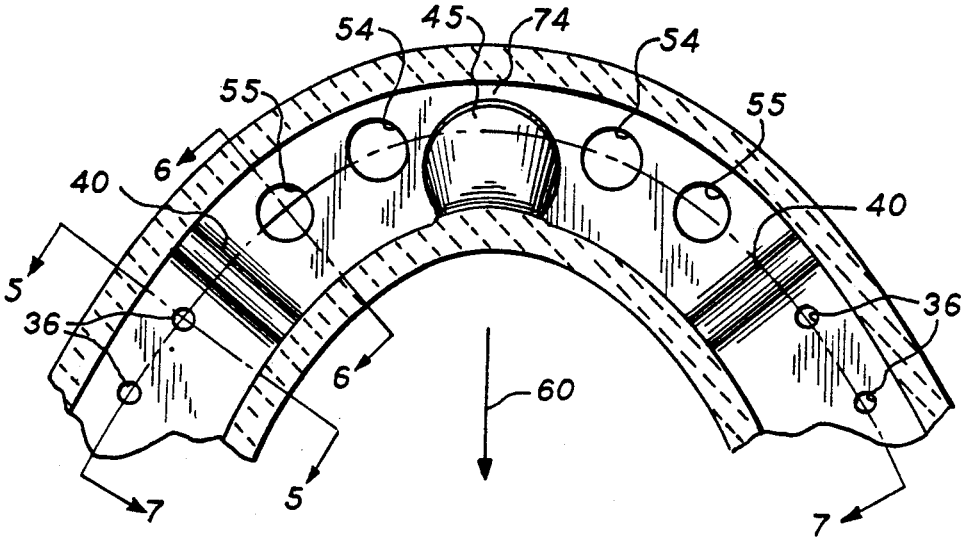
FIG. 4 is a partial sectional view taken along line 4—4 of FIG. 1.

Referring to FIGS. 2, and 4, the well 42 is centered along a longitudinal discharge axis 60 dividing the bowl 16 into equal halves. Preferably, this is the same axis that the water from the bowl 16 follows into the upleg 63 of the siphon.trapway 22. The vector 61 (see FIG. 3) along this axis 60 describes the vector of momentum which must be absorbed from the jet stream 56 by the water and waste in a sump 62 at the bottom of the bowl 16, to best accelerate that water and waste in a sufficient slug up into the siphon trapway 22.

The jet holes 54 are positioned close to the discharge axis 60 and symmetrically on either side of the discharge axis 60 to best align the momentum of the jet stream 56 with the discharge axis 60. The shepherding holes 55 flank the jet holes 54, and are further removed from the discharge axis 60. Because the shepherding holes 55 are further removed from the discharge axis 60, they are positioned within the rim 18 so as to direct the shepherding streams 57 with an increased inward orientation (i.e. the shepherding streams 56 cross the discharge axis 60 at a slight angle). Thus, the shepherding streams 57 serve to contain the spread of the jet streams 56 and focus the jet streams 56 into a single high momentum jet.

Referring to FIG. 2, during the initial stage of the flush process, flapper valve 28 is raised by a chain attached to the flush lever 14 allowing water 13 from the tank 12 to pass down into the receiving chamber 29. The water passing through openings 24 and 26 initially strikes the sloped floor 27 of the receiving chamber 29 and is then propelled forcefully forward into the rim 18. Referring next to FIG. 3, the water from the receiving chamber 29 passes into the rim 18, as shown by arrows 68, to travel through the rim 18 in both a clockwise and counter-clockwise direction.

During this stage of the flush, the water passes with great speed to the front of the rim 18 with very little exiting through cleaning holes 36. A peak water level 70 may be identified based on the usual rest volume of the water in tank 12, the volume of the rim 18 and receiving chambers 29, and the dynamic properties of the water flowing out into the bowl 16 through the holes 36, 54 and 55.

As the initial rush of water passes both clockwise and counter-clockwise to the front of the rim 18, the water impacts the well pools 72 on either side of the blocking member 45 and the momentum of the rushing water through the rim 18 is absorbed somewhat by the water in the well pools 72. Some of the water passes through the jet 54 and shepherding 55 holes out of the well 42 and into the bowl 16 forming jet and shepherding streams 56, 57 parallel to adjacent portions of the bowl 16.

The volume of water in excess of that which can quickly pass through the holes 54, 55 strikes the blocking member 45 and splashes back into its associated side of the well 50 without appreciably affecting the water pressure on the opposite side of the well 42 during the initial stages of flushing. The well 42 quickly fills up with water and the well pool 72 water levels rise.

With this blocking member 45, the primary factor affecting water pressure within the well 42 is the water level 70 and therefore asymmetrical toilet characteristics have less effect on water pressure and water jet orientation. Equal water pressure within both well pools 72 generates jet 56 and shepherding 57 streams that produce a water jet precisely aligned with the discharge axis 60.

Referring to FIG. 2, a small channel 74 can be provided within the blocking member 45 to allow an equilibrium water pressure to be established between the two halves of the well 42 during later stages of the flushing.

Referring to FIG. 3, the combined jet and shepherding streams 56, 57 can be focused into an even more concentrated jet 73 by a focusing groove 70 on the floor of the bowl 16. Preferably the groove 70 is in converging form (e.g., a V-shape trough). The groove extends from a point just below the seal recovery water level 67 to the sump 62. The depression of the focusing groove 70 diverts the cleaning streams 39 from cleaning holes 36, concurrent with the jet and shepherding streams 56, 57, to a direction more perpendicular to the discharge axis 60, thus serving to compress the flow of streams 56 and 57 at groove 70 into a compact, high momentum jet 73. This compact jet 73, impinging upon the water and waste collected in sump 62, insures that a substantial volume of water is accelerated up the upleg 63 of the siphon trapway 22 and down the downleg 65 hence producing an adequate siphoning action.

The water used during the cleaning stage of the flushing process can be controlled by adjusting the volume in the rim 18. Likewise, the water used during the siphoning stage of the flushing process may be accurately controlled by changing the radii of both the jet 54 and shepherding 55 holes.

While a preferred embodiment of the invention has been described, it should be apparent to those skilled in the art that many variations can be made without departing from the spirit of the invention. For example, referring to FIG. 6, the actual angular orientation of the side walls 47, 48 and ceiling 49 within the well 42 portion of the rim 18 may be different and still be within the scope of the invention. Also, a greater number of jet or shepherding holes 54, 55 may be positioned within the well 42 to change the power of the water jet. As such, the invention is not to be limited to just the illustrative descriptions above.

We claim:

1. A toilet, comprising:

a bowl having an upper lip and a lower wall having a sump portion at its base, the sump portion being connected through a bowl outlet to a siphon for the discharge of cleaning liquid and waste from the bowl;

a hollow rim for receiving cleaning liquid, the rim having a rim floor adjacent to the upper lip of the bowl, the rim being constructed and arranged to allow passage of cleaning liquid into the bowl through a first hole and a second hole;

a well having a well floor formed in the rim floor adjacent the front of the bowl; and wherein the first hole is formed in the rim floor, the second hole is formed in the well floor, and the second hole opens inside the rim at a lower level than the first hole opens inside the rim.

2. The toilet as recited in claim 1, wherein the second hole is larger than the first hole.

3. The toilet as recited in claim 2, wherein:

the well has a back and a front, the latter being toward the front of the bowl;

the well floor is higher at the back of the well than at the front of the well; and wherein a longitudinal axis defining said second hole extends through the back of the well floor and is parallel to an adjacent portion of the bowl lower wall.

4. The toilet as recited in claim 1, further including a blocking member within the well adjacent the front of the rim for limiting the flow of cleaning liquid along the front of the rim past the blocking member.

5. The toilet as recited in claim 4, wherein the blocking member is a projection extending upward from the well floor.

6. The toilet as recited in claim 5, wherein a third hole opens into the rim through an upper end of the projection to permit the passage of air out of the rim as water enters the rim.

7. The toilet as recited in claim 4, further having a plurality of such second holes, the second holes being spaced on both sides of the blocking member.

* * * * *